US005421706A

United States Patent [19]

Martin, Sr.

[11] Patent Number: 5,421,706

[45] Date of Patent: * Jun. 6, 1995

[54] VANE-TYPE FUEL PUMP

[76] Inventor: Thomas B. Martin, Sr., 1620 S.E. Cascade Ave., Vancouver, Wash. 98684

[ * ] Notice: The portion of the term of this patent subsequent to Jul. 13, 2010 has been disclaimed.

[21] Appl. No.: 24,673

[22] Filed: Mar. 1, 1993

Related U.S. Application Data

[63] Continuation-in-part of Ser. No. 733,469, Jul. 22, 1991, Pat. No. 5,226,803.

[51] Int. Cl.[6] ..... F04B 17/00

[52] U.S. Cl. ..... 417/371; 417/410.3; 418/255

[58] Field of Search ..... 417/371, 410.3; 418/255

[56] References Cited

U.S. PATENT DOCUMENTS

| | | | |
|---|---|---|---|
| 581,265 | 4/1897 | Bump . | |
| 607,684 | 7/1898 | Draper . | |
| 787,988 | 4/1905 | Moore . | |
| 1,020,995 | 3/1912 | Leeds . | |
| 1,078,301 | 11/1913 | Moore . | |
| 1,749,121 | 3/1930 | Barlow . | |
| 3,170,157 | 2/1965 | Schreitmueller . | |
| 3,181,589 | 5/1965 | Phelps . | |
| 3,237,852 | 3/1966 | Shaw . | |
| 3,891,355 | 6/1975 | Hecht et al. | 417/371 |
| 4,484,873 | 11/1984 | Inagaki et al. | 418/255 |
| 4,496,293 | 1/1985 | Nakamura et al. | 417/371 |
| 4,561,834 | 12/1985 | Poss | 418/255 |
| 4,743,176 | 5/1988 | Fry | 417/368 |
| 5,226,803 | 7/1993 | Martin | 417/371 |

*Primary Examiner*—Richard A. Bertsch
*Assistant Examiner*—William Wicker
*Attorney, Agent, or Firm*—Marger Johnson McCollom & Stolowitz

[57] ABSTRACT

A vane-type pump which including a housing having interior surfaces defining a pumping chamber having a diameccentric configuration. A diameccentric configuration is defined for purposes of this invention as a substantially circular shaped body whose constant diameter rotates about a point which is offset with respect to the centroid of that shaped body. The diameccentrically configured pumping chamber includes a perimeter section, a front wall, a rear wall, an intake port, a discharge port, an intake region, and a discharge region. A pump rotor is disposed within and is diameccentric to the pumping chamber for rotation within the pumping chamber for pressurizing and pumping a fluid. The pumping chamber, which typically has a generally elliptical shape, has a substantially uniform diameter when measured through the longitudinal center of the rotor. The perimeter of the pumping chamber in the discharge region has a shape such that fluid is discharged through the discharge port in a substantially uniform, non-pulsating flow. The outer edge of the outlet port is aligned with the perimeter of the pump housing to permit the unimpeded flow of entrained particulates out of the housing.

20 Claims, 3 Drawing Sheets

VANE-TYPE FUEL PUMP

RELATED APPLICATION

This is a Continuation-in-Part of U.S. Ser. No. 07/733,469, filed Jul. 22, 1991, now U.S. Pat. No. 5,226,803.

BACKGROUND OF INVENTION

This invention relates to an improved vane-type fuel pump for delivering fuel, and particularly to an improved vane-type fuel pump for delivering fuel from a locomotive storage tank to a locomotive engine.

Diesel electric locomotives are fitted with various auxiliary electrical components which together make up the auxiliary electrical system. The auxiliary electrical system includes a DC motor driven, positive displacement fuel pump to deliver fuel to the locomotive engine. The pump is powered by the locomotive's 64 volt batteries during start-up of the locomotive, and by a 74 VDC auxiliary generator while the locomotive is running.

One design of positive displacement pumps that may be used as a locomotive fuel pump is the vane-type rotary pump. A vane pump can provide a relatively constant discharge pressure throughout a range of flow rates, and is fairly compact as well.

A vane pump includes a cylindrical pump chamber with a rotor mounted eccentrically within the chamber. The rotor incorporates vanes which define successive pumping chambers by maintaining contact with the perimeter wall of the housing at prescribed angular intervals throughout the rotation of the rotor. As the rotor turns, the volume of each pumping chamber alternatively increases and decreases due to the eccentricity of the rotor relative to the perimeter of the housing. In this way, fluid is alternately drawn into and discharged from each chamber, discharging a pulsating flow of fluid from the pump.

Owing to the eccentricity of the rotor relative to the circular housing, the distance between opposing wails of the housing measured through the center of the rotor varies as the rotor turns within the housing. Since the vanes must maintain contact with the housing wall throughout the rotation of the rotor, the vanes must adjust to this variation as the rotor turns.

As the required pump output volume is increased, greater eccentricity and/or higher rotor speeds are required. As the pump eccentricity is increased, the vanes must be adjustable over a greater range of lengths, and the rate of radial travel of the vane tip increases for a given rotor speed. As the rotor speed is increased, the rate of adjustment of the vane length must also increase accordingly.

An additional consequence of increased eccentricity and rotor speed of the vane-type pump is increased amplitude and frequency of vibrations associated with pulsations in the discharge from the pump. These vibrations can have a negative impact on the integrity of numerous structural components, including piping systems, seals, electrical connections, gauges, etc. In addition, the pump must be able to accommodate solid impurities in the fuel without jamming, breaking, or unduly wearing.

One result of these numerous and difficult design requirements are systems which include complex rotors and vanes having numerous moving parts. These complex designs in turn lead to high capital equipment costs, a high level of wear with respect to the equipment, and high maintenance requirements. The high level of wear and the high maintenance requirements are further aggravated by the fact that the pump must be operated continuously while the locomotive is running.

The continuous use of the locomotive fuel pump also leads to additional maintenance problems with the DC drive motor. Frequent replacement of the brushes is required, and the internal parts of the DC motor are not easily protected from the operating environment of the locomotive. For example, the DC motor must be covered during normal cleaning of the locomotive to protect it from water damage.

Numerous vane-type pump designs are described in the literature. U.S. Pat. No. 1,020,995 to Seaman discloses a rotary pump having a cylindrical housing 20 with eccentrically mounted rotor assembly 17 mounted on concentric shaft 18. Vane 26 is carded on rotor 17 in openings 25 for sliding across the axis of rotor 17 as rotor 17 turns. Vane 26 has an elongated slot 31 which receives roller 29 which is carried on concentrically mounted stud 30 in cylinder 20. During operation, the ends of vane 26 are equidistant from the walls of cylinder 20. the distance between the vane ends and the walls of cylinder 20 varies constantly as rotor 17 rotates in cylinder 20. Rollers 27 are mounted in the ends of vane 26, and as rotor 17 is rotated, centrifugal force moves rollers 27 outwardly into contact with the walls of cylinder 20, providing a vane of varying effective length.

U.S. Pat. No. 1,749,131 to Barlow discloses a rotary pump having rotor 5 eccentrically mounted in housing 1. Rotor 5 has multiple slots 7 having rollers 8 disposed partially within. Rollers 8 are smaller in diameter than the width and depth of slots 7. As rotor 5 rotates within housing 5, the distance between the ends of slots 7 and the cylinder wall varies constantly. A complex system of ports and 22, 23 and channels 14–19 are machined into various components to apply pressure to the under side of rollers 8 to move them outwardly as the distance between the slot 7 and the cylinder wall increases, and to relieve fluid pressure under roller 8 as the distance between roller 7 and the cylinder wall decreases and roller 8 is forced into the slot. In this way, the effective diameter of the rotor 5 is varied during rotation. By rotating rotor 5 in the cylindrical housing, a somewhat pulsating flow of fluid is delivered to discharge port 10.

U.S. Pat. No. 3,170,157 to Hanson discloses a design for a rotary pump design in which a fluid refrigerant is compressed between a leading edge **36*a* of vane 30 and a first surface of abutment 51, and subsequently expanded between a trailing edge 36*b* of vane 30 and abutment 51. The outer end of vane 30 is sealed against the inner surface 15 of housing 12 by a roller 37 disposed within a recess 38. Vane 30 reciprocates within groove 27, and is urged outward by spring 41. In this way, the effective length of vane 30 is varied as rotor 25 is rotated within housing 12**.

U.S. Pat. Nos. 3,181,589 to Cramer, 3,237,852 to Shaw, 3,891,355 to Hecht, and 4,743, 186 to Fry disclose motor driven pumps which circulate working fluid as a coolant for the drive motor.

Eccentric rotor steam engine designs are disclosed in U.S. Pat. No. 581,265 to Bump, U.S. Pat. No. 607,684 to Draper, and U.S. Pat. Nos. 787,988 and 1,078,301 to Moore.

A need therefore exists for a compact, reliable fuel pump which delivers a continuous, smooth flow of fuel to the locomotive engine, and which exhibits lower capital costs, wear rates, and maintenance requirements.

SUMMARY OF THE INVENTION

The pump of the present invention meets all of the above-described existing needs and by providing a compact, reliable fuel pump which delivers a continuous, smooth flow of fuel to a locomotive engine. At the same time the subject pump exhibits lower capital costs, reduced wear rates, and substantially diminish maintenance requirements.

The pump includes a pump housing having interior surfaces defining a pumping chamber having a diameccentric configuration. A diameccentric configuration is defined for purposes of this invention as a substantially circular shaped body whose constant diameter rotates about a point which is offset with respect to the centroid of that shaped body. The diameccentrically configured pumping chamber includes a perimeter section, a front wall, a rear wall, an intake port, a discharge port, an intake region, and a discharge region.

A pump rotor is disposed within and is diameccentric to the pumping chamber for rotation within the pumping chamber for pressurizing and pumping a fluid. The pumping chamber, which typically has a generally elliptical shape, has a substantially uniform diameter when measured through the longitudinal center of the rotor. The perimeter of the pumping chamber in the discharge region has a shape such that fluid is discharged through the discharge port in a substantially uniform, non-pulsating flow. More specifically, the pump rotor has several specific advantageous characteristics including (a) a rotor face disposed substantially perpendicular to the axis of rotation of the rotor, (b) surfaces defining a pair of intersecting, perpendicular channels having a bottom wall and two side walls, the intersecting, perpendicular channels intersecting at a center portion of the rotor face and extending on each end to the perimeter of the rotor face, and (c) being positioned axially within the pumping chamber so that the rotor face is aligned with the front wall of the pumping chamber.

The pump also includes a pair of elongated vanes. One of the elongated vanes is slidably disposed within each of the channels. Each of the vanes has a length less than the diameter of the elliptical pumping chamber. The vanes also have side surfaces for sealingly engaging the front and rear walls of the pumping chamber when the rotor is rotated within the pumping chamber, and surfaces in each end defining an elongated recess parallel to the axis of rotation of the rotor.

Finally, the pump includes a roller disposed within each of the elongated recesses for sealing engagement with the pumping chamber when the rotor is rotated within the pumping chamber. Each of the rollers has ends for slidable sealing engagement with the front and rear walls of the pumping chamber when the rotor is rotated within the pumping chamber. It also has a diameter less than the width of the elongated recess. In this way, when the rotor is rotated within the housing to pressurize and pump a fluid, the pressurized fluid is admitted into the recess below the roller, the pressurized fluid thereby urging the roller outward into sealing engagement with the pumping chamber perimeter.

The pump can also comprise an electric motor assembly drivably connected to the pump rotor for rotating the pump rotor within the pumping chamber. Preferably, the electric motor assembly includes a brushless alternating current motor and an inverter for converting a direct current to an alternating current for powering the alternating current motor. The pump directs the fluid into the intake region of the pumping chamber for conducting pressurizing and pumping operations. In one form of this invention, the motor and pump can be protectively sealed from the environment.

The pump can also comprise means for cooling the motor with a fluid to be pumped by the pump. The means for cooling the motor preferably includes a cavity surrounding a portion of the motor, means for releasing a quantity of fluid to be pumped from the intake port into the cavity, means for circulating the quantity of fluid around a portion of the motor for cooling the motor, and means for directing the quantity of fluid from the cavity into the pumping chamber intake region for being pressurized and pumped. As for the means for releasing a quantity of fluid from the inlet port into the cavity, it preferably includes surfaces defining a passage therebetween. Moreover, the means for circulating the quantity of fluid around a portion of the motor typically includes a cavity surrounding a portion of the motor, and a rotating portion of the motor for propelling the fluid through the cavity. Finally, the means for directing the quantity of fluid from the cavity into the pumping chamber inlet region for being pressurized and pumped can also include surfaces defining a passage therebetween.

A second embodiment of the invention includes a pump housing in which the outer edge of the outlet port is aligned with the perimeter wall of the pumping chamber to allow entrained particulate solids to pass unimpeded through the pumping chamber.

DETAILED DESCRIPTION OF THE PREFERRED EMBODIMENT

Figure 1:
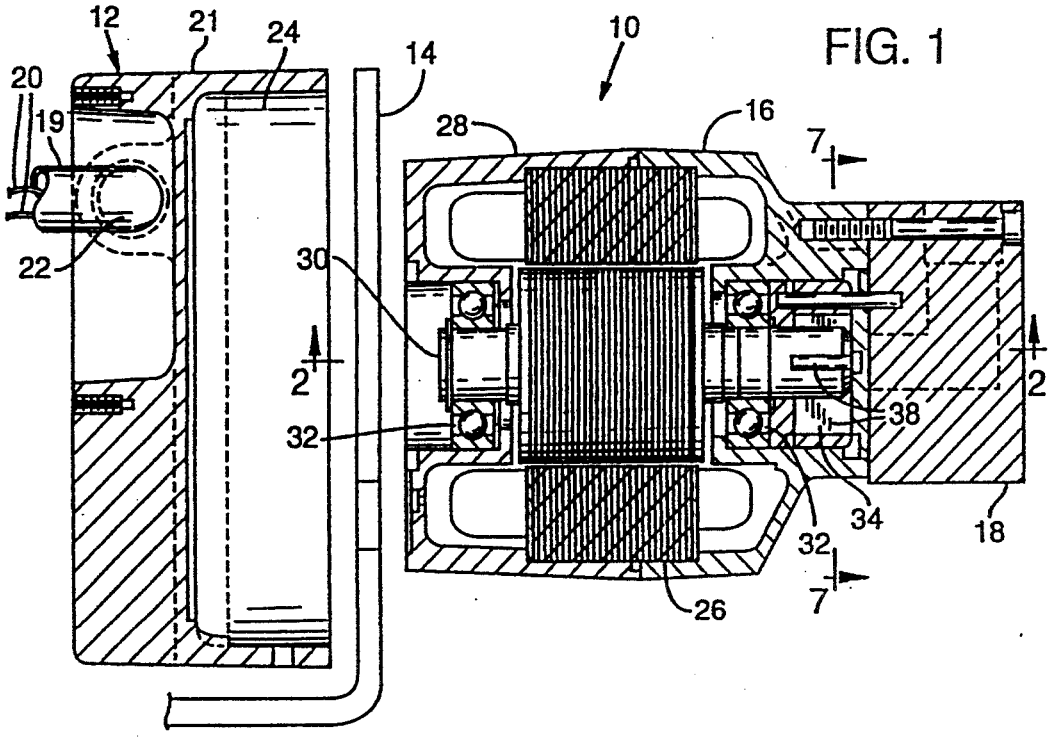
FIG. 1 is an enlarged sectional view of the of the locomotive fuel pump of the present invention.

Referring to FIG. 1, vane-type locomotive fuel pump 10 generally includes electronic controller assembly 13 connected to mounting bracket 15, which in turn is joined to motor/pump assembly 17 and pump manifold 18. Electronic controller assembly 13 includes a conduit 20 which contains DC feed wires 20. DC feed wires 20 carry 74 VDC electrical current from a locomotive auxiliary electrical system (not shown). DC feed wires 20 enter an electronic controller casing 21 through boss 22, and connect to circuit board 24. Circuit board 24, which is Part No. 10288, manufactured by Enermorphics Corp. of Oakland, Calif., converts the 74 VDC current to 54 volts AC, which in turn powers motor 26.

Figure 2:
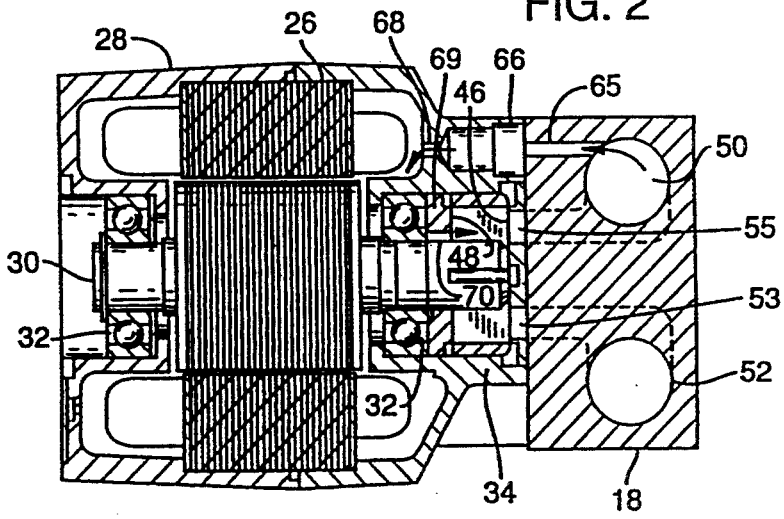
FIG. 2 is an enlarged sectional view of the motor/-pump assembly 17 of the locomotive fuel pump taken along line 2—2 of FIG. 1.
Figure 3:
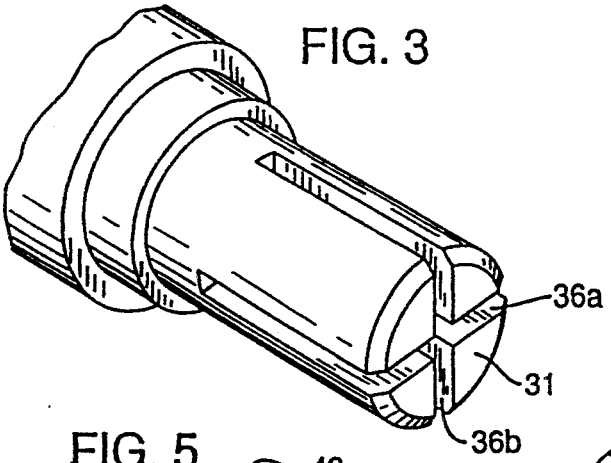
FIG. 3 is a perspective sectional view of the rotor 30 without vanes 38.
Figure 4:
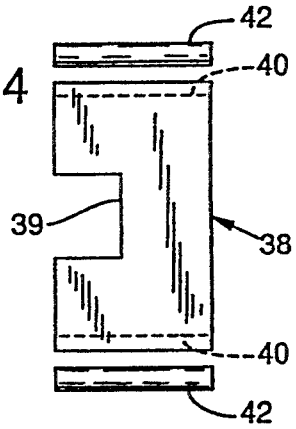
FIG. 4 is a front view of vane 38.
Figure 6:
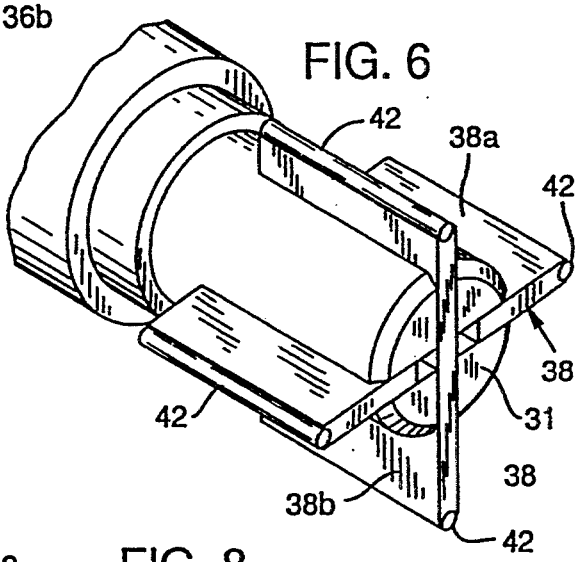
FIG. 6 is a perspective sectional view of the rotor 30 including vanes 38.

Turning now to FIG. 2, motor 26 includes rotor 30 mounted in cage-type ball beatings 32 in casing 28. Rotor 30 extends eccentrically into diameccentrically-shaped, diameccentrically-elongated pump housing 34 and terminates at rotor face 31 at front wall 46. A diameccentrical shape is a substantially circular shaped body whose constant diameter rotates about a point which is offset with respect to the centroid of that shaped body. As best seen in FIG. 3, two perpendicular vane channels 36*a* and 36*b* are formed in rotor face 31. Identical sliding vanes 38 are fitted into rotor face 31, one each into each of the channels 36*a* and 36*b*. Each sliding vane 38 has a notch 39 which provides the clearance required for vanes 38*a* and 38*b* to be fitted simultaneously into channels 36*a* and 36*b* respectively (See FIG. 6). Notch 39 also allows vanes 38*a* and 38*b* to slide relative to each other in channels 36*a* and 36*b* as pump rotor 30 rotates.

Figure 5:
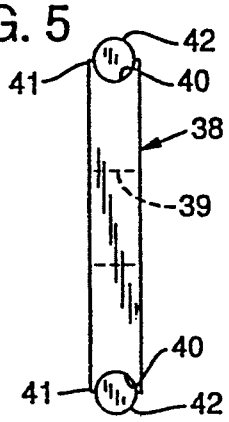
FIG. 5 is a left side view of the vane 38 of FIG. 4.

As depicted in FIG. 5, each end 41 of vanes 38*a* and 38*b* has a recess 40 formed therein. Roller 42 is received in each recess 40 and, as more fully explained below, is maintained in rolling contact with pump chamber perimeter 44 (See FIG. 7) as pump rotor 30 and vanes 38*a* and 38*b* are rotated. Vanes 38*a* and 38*b* and rollers 42 are sized in their length to maintain a sliding clearance with pump housing front wall 46 and rear wall 48.

Returning now to FIG. 2, intake port 50 and discharge port 52 are formed in pump manifold 19. Intake port 50 directs fuel from the locomotive fuel storage system (not shown) into pump housing intake region 51. Discharge port 52 carries fuel from pump housing discharge region 53 to the locomotive engine fuel supply piping system (not shown).

Figure 7:
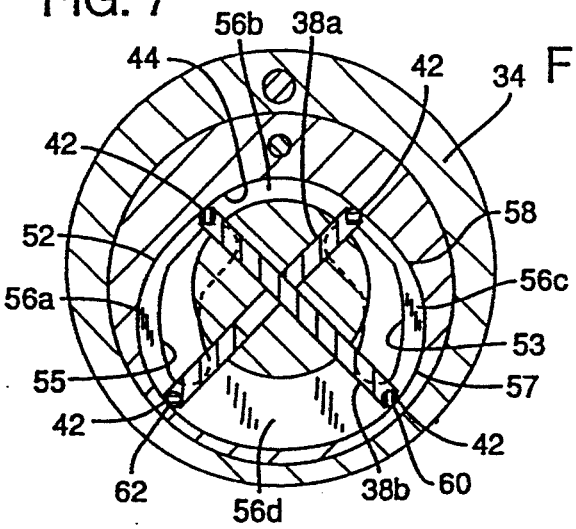
FIG. 7 is an enlarged sectional view of the locomotive fuel pump taken along line 7—7 of FIG. 1.

Referring to FIG. 7, four pumping cells, 56*a–d*, are formed by adjacent surfaces of vanes 38*a* and 38*b*, pump housing perimeter 44, front wall 46, rear wall 48, and outside diameter of rotor 30. Adjacent pumping cells 56*a–d* are isolated from one another by rollers 42 maintained in rolling contact with housing perimeter 44 as explained below.

In operation, 74 VDC is supplied to circuit board 24 where it is converted to 54 VAC which drives motor 26 turning pump rotor 30 in pump housing 34. Cell 56*a* is shown in communication with intake region 51. As pump rotor 30 rotates, vane 38*a* passes over intake region 51. Due to the diameccentric position of pump rotor 30 in pump housing 34, and the diameccentric elongated shape of pump housing perimeter 44, the volume of cell 56*a* increases as pump rotor 30 is rotated further, lowering the pressure in cell 56*a* and drawing fuel into cell 56*a* through intake port 50. As rotation continues, vane 38*a* moves past intake region 51 to perimeter point 62, at which point cell 56*a* is sealed off from intake region 51. Vane 38*b* is now at perimeter point 60 exposing cell 56*a* to discharge pressure from discharge region 53. The volume of cell 56*a* is now at its maximum. Further rotation delivers constant flow to discharge region 53 until vane 38*a* reaches perimeter point 60.

Figure 8:
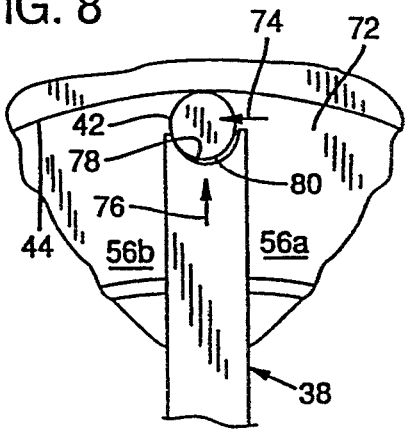
FIG. 8 is an enlarged section view of the end of one of the vanes 38 within cells **56*a* and 56*b***.

The pressurization of cell 56*a* results in the sealing of cell 56*a* from the following adjacent cell 56*b* as best seen in FIG. 8. Recess 40 has a diameter greater than that of roller 42. As cell 56*a* is pressurized, pressurized fuel 72 in cell 56 enters recess 40 and exerts a rearward force 74 and outward force 76 on roller 42, urging roller 42 rearwardly into sealing contact with rear recess edge 78 and outwardly into sealing contact with pump housing perimeter 44. Pressurized fuel filled space 80 beneath roller 42 also allows roller 42 to momentarily be displaced inwardly if an impurity particle (not shown) should enter pumping cell 56*a* and pass between roller 42 and perimeter 44, thus preventing damage to roller 42 and perimeter 44.

Returning now to FIG. 7, as vane 38*a* passes point 60, the volume of cell 56*a* decreases with continued rotation due to the eccentric position of rotor 30 and the diameccentrical elongated shape of perimeter 44 in discharge region 53. Pressurized fuel 72 is forced out of cell 56*a* through discharge port 52 and delivered to the locomotive diesel engine for combustion. By the time vane 38*a* passes point 60, vane 38*b* has passed point 62, placing cell 56*b* in communication with discharge port 52 and pressurizing the fuel in cell 56*b*. The effect of overlapping communication of sequential pumping cells 56*a* and 56*b* is an even pressured, non-pulsating discharge of fuel from pump 10. The elimination of a pulsating discharge characteristic of other fuel pump designs greatly reduces vibration transmitted to the associated piping systems, leading to quieter operation and enhanced reliability in the locomotive.

As pump rotor 30 is rotated in pump housing 34, vanes 38*a* and 38*b* maintain a substantially uniform length due to the constant diameter of diameccentrical elongated pump housing 34 when measured through the center of pump rotor 30. Vanes 38*a* and 38*b* slide within vane channels 36*a* and 36*b* to maintain their position substantially centered between opposite points on perimeter 44. A small amount of fuel flows along channels 36*a* and 36*b* beneath vanes 38*a* and 38*b* respectively for lubricating the sliding action of vanes 38*a* and 38*b*.

During operation of pump 10, motor beatings 32 are lubricated by a small amount of fuel circulated from intake port 50 through casing 28. Fuel flows from intake port 50 through lubrication bleed port 65 and into settling chamber 66, where any entrained particles can settle out. Fuel then flows through lubrication intake port 68 into casing 28, where it is circulated by the rotation of rotor 30. The lubricating flow of fuel is then discharged from casing 28 into pump housing intake region 51 through lubrication discharge port 70 formed in pump sealing ring 69. The small pressure difference between intake port 50 and pump housing intake region 51 resulting from the suction head loss in drawing the main fuel flow through intake port 50 to intake region 51 provides a positive circulation head for the lubricating flow of fuel.

Further, the flow of lubricating fuel through lubrication discharge port 70 continually flushes pump rotor 30 where it contacts pump sealing ring 69, reducing wear and damage to both pump rotor 30 and pump sealing ring 69.

Figure 9:
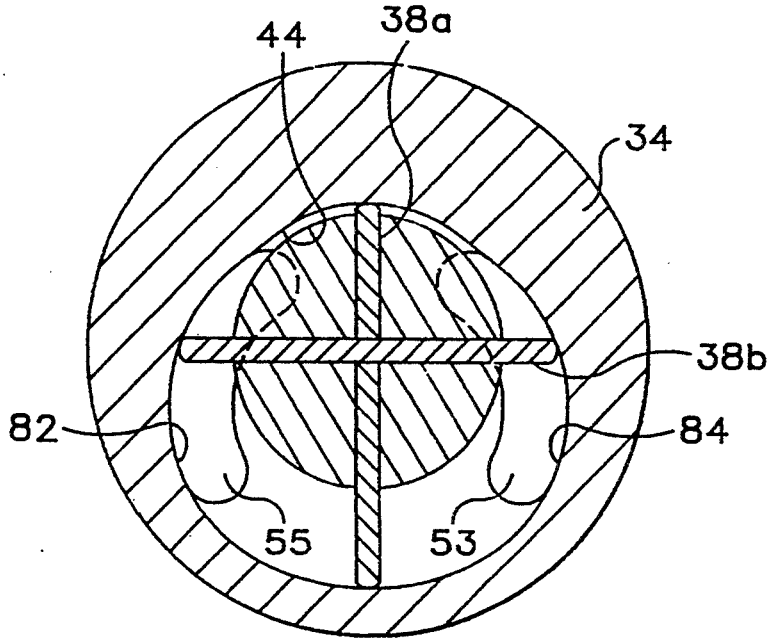
FIG. 9 is an enlarged sectional view of an alternative embodiment of the locomotive fuel pump, taken along line 7—7 of FIG. 1.

FIG. 9 shows an alternative embodiment of the present invention in which the inlet and outlet ports 55 and 53 are modified to allow solid particles to be flushed continuously through the pumping chamber. The respective outer edges 82 and 84 inlet port 55 and outlet port 53 are formed in axial alignment with the perimeter wall 44 of the pumping chamber to form a continuou, uninterrupted flow path between the ports and the pumping chamber. The elimination of a raised lip as visible in FIG. 7 between the outlet port and the pumping chamber eliminates the principal impediment to passage of particles out of the pumping chamber with the fluid. This is due in part due to the centrifuge-like action of the pump, which causes heavier solid particles to accelerate outwardly toward the perimeter wall as the fluid is pumped in a generally circular path through the pumping chamber.

Having fully described the novel features and the preferred embodiment of the present invention, it will be readily apparent to one skilled in the art of locomotive fuel pump design that details of design and construction may be varied without departing from the scope and spirit of the present invention.

I claim:

1. A pump comprising:

a pump housing including surfaces defining a pumping chamber having a diameccentric configuration including a perimeter wall, a front wall, a rear wall, an intake port, a discharge port formed in the rear wall, an intake region, and a discharge region;

a pump rotor rotatably mounted within and diameccentric to the pumping chamber and adapted for pressurizing and pumping an incompressible fluid, the pumping chamber having a uniform diameter when measured through the longitudinal center of the rotor, the perimeter of the pumping chamber in the discharge region having a shape such that said incompressible fluid is discharged through the discharge port in a substantially uniform, non-pulsating flow;

the pump rotor having a rotor face disposed substantially perpendicular to the axis of rotation of the rotor, and having surfaces defining a pair of intersecting, perpendicular channels having a bottom wall and two side walls, the intersecting, perpendicular channels intersecting at a center portion of the rotor face and extending on each end to the perimeter of the rotor face, the pump rotor being positioned axially within the pumping chamber so that the rotor face is aligned with the front wall of the pumping chamber;

a pair of elongated vanes, one of the elongated vanes slidably disposed within each of the channels, the vanes having end surfaces for slidably engaging the perimeter wall of the pumping chamber as the rotor is rotated, and having side walls for sealingly engaging the pumping chambers front and rear walls when the rotor is rotated; and said housing and said vanes cooperatively defining four rotatable pumping chambers, each said pumping chamber for receiving a quantity of incompressible fluid as said pumping chamber is rotated into communication with said intake port, and each said pumping chamber defining a constant volume for confining said incompressible fluid until said pumping chamber is in communication with said discharge port.

2. The pump of claim 1 wherein the outlet port has an edge portion aligned with the pumping chamber perimeter wall.

3. A pump according to claim 1 further comprising an electric motor assembly drivably connected to the pump rotor for rotating the pump rotor within the pumping chamber.

4. A pump according to claim 3 wherein electric motor assembly includes:

a brushless alternating current motor; and an inverter for convening a direct current to an alternating current for powering the alternating current motor.

5. A pump according to claim 3 wherein the motor and pump are protectively sealed from the environment, and whereby the pump directs the fluid into the intake region of the pumping chamber for conducting pressurizing and pumping operations.

6. A pump according to claim 3 further comprising means for cooling the motor with a fluid to be pumped by the pump.

7. A pump according to claim 6 wherein the means for cooling the motor includes a cavity surrounding a portion of the motor, means for releasing a quantity of fluid to be pumped from the intake port into the cavity, means for circulating the quantity of fluid around a portion of the motor for cooling the motor, and means for directing the quantity of fluid from the cavity into the pumping chamber intake region for being pressurized and pumped.

8. A pump according to claim 7 in which the means for releasing a quantity of fluid from the inlet port into the cavity includes surfaces defining a passage therebetween.

9. A pump according to claim 7 in which the means for circulating the quantity of fluid around a portion of the motor includes a cavity surrounding a portion of the motor, and a rotating portion of the motor for propelling the fluid through the cavity.

10. A pump according to claim 7 in which the means for directing the quantity of fluid from the cavity into the pumping chamber inlet region for being pressurized and pumped includes surfaces defining a passage therebetween.

11. A locomotive having a diesel engine, a diesel fuel storage tank, a direct current auxiliary electric system including an electric fuel pump for pumping incompressible fuel from the fuel storage tank to the diesel engine, the locomotive fuel pump comprising:

a pump housing including surfaces defining a pumping chamber having a diameccentric configuration including a perimeter wall, a front wall, a rear wall, an intake port, a discharge port formed in the rear wall, an intake region, and a discharge region;

a pump rotor rotatably mounted within and diameccentric to the pumping chamber and adapted for pressurizing and pumping an incompressible fluid, the pumping chamber having a uniform diameter when measured through the longitudinal center of the rotor, the perimeter of the pumping chamber in the discharge region having a shape such that said incompressible fluid is discharged through the discharge port in a substantially uniform, non-pulsating flow;

the pump rotor having a rotor face disposed substantially perpendicular to the axis of rotation of the rotor, and having surfaces defining a pair of intersecting, perpendicular channels having a bottom wall and two side walls, the intersecting, perpendicular channels intersecting at a center portion of the rotor face and extending on each end to the perimeter of the rotor face, the pump rotor being positioned axially within the pumping chamber so that the rotor face is aligned with the front wall of the pumping chamber;

a pair of elongated vanes, one of the elongated vanes slidably disposed within each of the channels, the vanes having end surfaces for slidably engaging the perimeter wall of the pumping chamber as the rotor is rotated, and having side walls for sealingly engaging the pumping chamberfront and rear wall when the rotor is rotated; and said housing and said vanes cooperatively defining four rotatable pumping chambers, each said pumping chamber for receiving a quantity of incompressible fluid as said pumping chamber is rotated into communication with said intake port, and each said pumping chamber defining a constant volume for confining said incompressible fluid until said pumping chamber is in communication with said discharge port.

12. A locomotive fuel pump according to claim 11 wherein the outlet port has an edge portion aligned with the pumping chamber perimeter wall.

13. A locomotive fuel pump according to claim 12 further comprising an electric motor assembly drivably connected to the pump rotor for rotating the pump rotor within the pumping chamber.

14. A locomotive fuel pump according to claim 13 wherein electric motor assembly includes:

a brushless alternating current motor;

an inverter for converting a direct current to an alternating current for powering the alternating current motor.

15. A locomotive fuel pump according to claim 13, wherein the motor and pump are protectively sealed from the environment, and whereby the pump directs the fuel into the intake region of the pumping chamber for conducting pressurizing and pumping operations.

16. A locomotive fuel pump according to claim 13 and which further comprises means for cooling the motor with the fuel to be pumped by the pump.

17. A locomotive fuel pump according to claim 16 wherein the motor cooling means includes a cavity surrounding a portion of the motor, means for releasing a quantity of fuel to be pumped from the inlet port into the cavity, means for circulating the quantity of fuel around a portion of the motor for cooling the motor, and means for then directing the quantity of fuel from the cavity into the pumping chamber inlet region for being pressurized and pumped.

18. A locomotive fuel pump according to claim 17 in which the means for releasing a quantity of fuel from the inlet port into the cavity includes surfaces defining a passage therebetween.

19. A locomotive fuel pump according to claim 17 in which the means for circulating the quantity of fuel around a portion of the motor includes a rotating portion of the motor for propelling the fuel through the cavity.

20. A locomotive fuel pump according to claim 17 in which the means for directing the quantity of fuel from the cavity into the pumping chamber inlet region for being pressurized and pumped includes surfaces defining a passage therebetween.

* * * * *